US008213840B2

(12) United States Patent
Koido et al.

(10) Patent No.: US 8,213,840 B2
(45) Date of Patent: Jul. 3, 2012

(54) DEVELOPER MATERIAL HOLDING APPARATUS, PROCESS CARTRIDGE TO WHICH THE DEVELOPER MATERIAL HOLDING APPARATUS IS ATTACHED, AND IMAGE FORMING APPARATUS TO WHICH THE PROCESS CARTRIDGE IS ATTACHED

(75) Inventors: Shigenori Koido, Tokyo (JP); Junichi Itou, Tokyo (JP); Alan Davidson, Cumbernauld (GB); Peter Barnes, Cumbernauld (GB)

(73) Assignees: Oki Data Corporation, Tokyo (JP); Oki (UK) Ltd., Cumbernauld, Scotland (GB)

( * ) Notice: Subject to any disclaimer, the term of this patent is extended or adjusted under 35 U.S.C. 154(b) by 329 days.

(21) Appl. No.: 12/385,048

(22) Filed: Mar. 30, 2009

(65) Prior Publication Data

US 2009/0245883 A1 Oct. 1, 2009

(30) Foreign Application Priority Data

Mar. 31, 2008 (JP) ..... 2008-091844

(51) Int. Cl.
*G03G 15/08* (2006.01)
*G03G 15/10* (2006.01)

(52) U.S. Cl. ..... 399/262; 399/120; 399/244; 399/260

(58) Field of Classification Search ..... 399/120, 399/244, 258, 260, 262, 263
See application file for complete search history.

(56) References Cited

U.S. PATENT DOCUMENTS 3,865,612 A * 2/1975 Jo et al. ..... 430/121.1
5,572,300 A * 11/1996 Yamasa et al. ..... 399/260

FOREIGN PATENT DOCUMENTS

| | | |
|---|---|---|
| JP | 4-323680 | 11/1992 |
| JP | 4-350870 | 12/1992 |
| JP | 11-272055 | 10/1999 |
| JP | 11-272142 | 10/1999 |
| JP | 2000-122484 | 4/2000 |
| JP | 2000-310905 | 11/2000 |
| JP | 2006-243446 | 9/2006 |
| JP | 2006-309016 | 11/2006 |
| JP | 2007-156269 | 6/2007 |
| JP | 2007-264145 | 10/2007 |

* cited by examiner

*Primary Examiner* — David Gray
*Assistant Examiner* — Joseph S Wong
(74) *Attorney, Agent, or Firm* — Rabin & Berdo, P.C.

(57) ABSTRACT

A developer material holding apparatus holds a developer. A body holds a developer material and includes a first opening through which the developer material is discharged. A shutter is assembled to the body, and is movable either to an opening position where the developer material is discharged from the body or to a closing position where the developer material is not discharged from the body. The shutter includes a second opening such that when the shutter is at the opening position, the second opening is in alignment with the first opening. At least one of the first opening and the second opening is in the form a mesh including a plurality of openings.

16 Claims, 9 Drawing Sheets

DEVELOPER MATERIAL HOLDING APPARATUS, PROCESS CARTRIDGE TO WHICH THE DEVELOPER MATERIAL HOLDING APPARATUS IS ATTACHED, AND IMAGE FORMING APPARATUS TO WHICH THE PROCESS CARTRIDGE IS ATTACHED

BACKGROUND OF THE INVENTION

1. Field of the Invention

The present invention relates to a developer material holding apparatus, a process cartridge to which the developer material holding apparatus is attached, and an image forming apparatus to which the process cartridge is attached.

2. Description of the Related Art

Some conventional image forming apparatuses use a powder developer material, e.g., toner. A toner cartridge holds a developer material or toner therein, and is detachably attached to a process cartridge of the image forming apparatus. The toner cartridge includes a casing that defines a toner chamber, and a shutter that is rotatably accommodated in the casing. The casing includes a toner discharging opening formed therein, and the shutter includes another toner discharging opening formed therein. The openings are substantially equal in size. When the shutter is rotated relative to the casing to a position where the toner discharging openings are in alignment with each other the toner is discharged from the toner chamber into the process cartridge of the image forming apparatus. JP 2006-243446 discloses one such toner cartridge.

The conventional toner cartridge is mounted on top of the process cartridge, so that the toner is discharged through the toner discharging opening formed in the casing into a toner receiving opening formed in the process cartridge. Thus, the whole toner in the toner cartridge directly exerts pressure on the toner in the process cartridge, so that the toner in the process cartridge is compressed.

SUMMARY OF THE INVENTION

A developer material holding apparatus holds a developer. A body holds a developer material and includes a first opening through which the developer material is discharged. A shutter is assembled to the body, and is movable either to an opening position where the developer material is discharged from the body or to a closing position where the developer material is not discharged from the body. The shutter includes a second opening such that when the shutter is at the opening position, the second opening is in alignment with the first opening. At least one of the first opening and the second opening is in the form a mesh including a plurality of openings.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DETAILED DESCRIPTION OF THE INVENTION

First Embodiment

{Construction}

Figure 1:
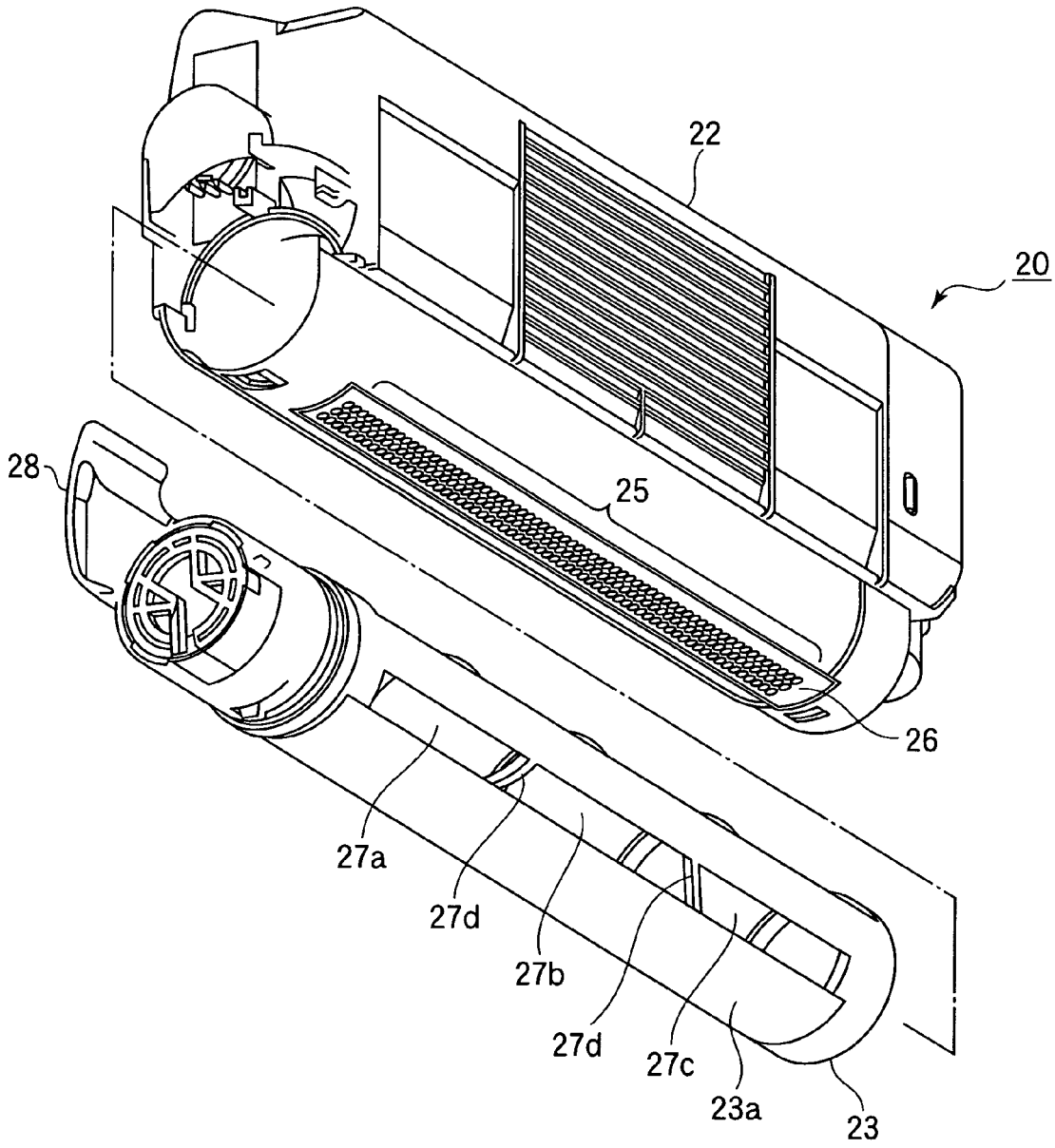
FIG. 1 is an exploded perspective view of a developer material holding apparatus or a toner cartridge of the first embodiment.

The present invention will be described in detail with reference to the accompanying drawings. Common elements have been given the same or similar reference numerals throughout the drawings.

FIG. 1 is an exploded perspective view of a developer material holding apparatus or a toner cartridge 20 of a first embodiment.

Figure 2:
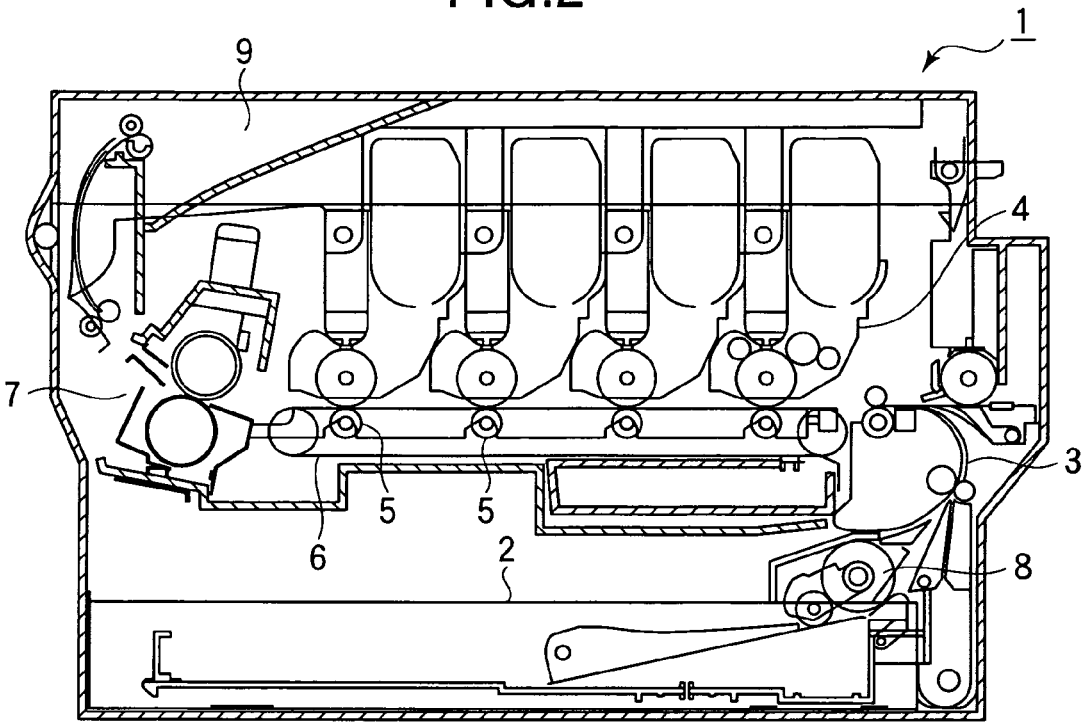
FIG. 2 illustrates a general configuration of an image forming apparatus in which the toner cartridge is used.

FIG. 2 illustrates a general configuration of an image forming apparatus 1 in which the toner cartridge 20 is used.

Figure 3:
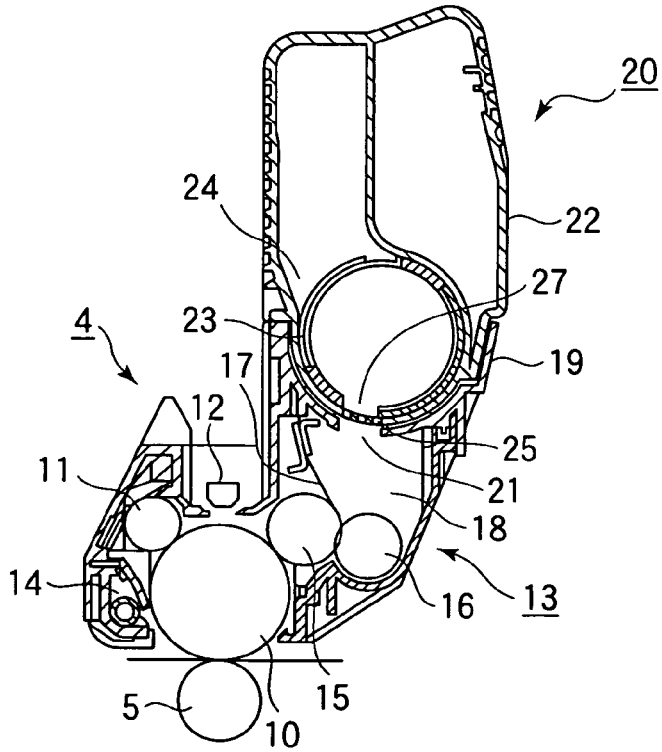
FIG. 3 is a cross sectional view illustrating a process cartridge to which the toner cartridge is attached.

FIG. 3 is a cross sectional view of the toner cartridge 20 attached to a developing unit 13.

Referring to FIG. 2, the image forming apparatus 1 includes a medium cassette 2 that holds a stack of print media therein, a transport path 3 in which the print medium is transported, print engines or process cartridges 4 that form images of corresponding colors (black, yellow, magenta, and cyan) in accordance with print data, transfer rollers 5 that transfer the corresponding color images onto which the print medium, a transfer belt 6 that transports the print medium through the print process cartridges 4, and a fixing unit where the images are fused into the print medium. Four of the process cartridges 4 are employed, and are of the identical configuration, differing only in color.

The general operation of the image forming apparatus 1 will be described. Upon initiation of a print operation, the print medium is advanced by a feeding roller 8 from the medium cassette 2, and is then transported in the transport path 3 to the print process cartridges 4. Each print process cartridge 4 forms a toner image of a corresponding color in accordance with print data. The toner images of the respective colors are formed in timed relation with the transportation of the print medium, and are transferred onto the print medium in sequence. Then, the print medium is further advanced to the fixing unit 7 where the toner images on the print medium are fused into a permanent image. The print medium is then transported to a stacker defined on top of the image forming apparatus 1.

Referring to FIG. 3, each process cartridge 4 includes a photoconductive drum 10, a charging roller 11, a light emitting diode (LED) head 12, a developing unit 13, and a cleaning section 14. The charging roller 11 uniformly charges the entire circumferential surface of the photoconductive drum 10. The LED head 12 illuminates the charged surface of the photoconductive drum 10 in accordance with the print data. The cleaning section 14 removes the residual toner remaining on the photoconductive drum 10.

The developing unit 13 includes a developing roller 15 and a supplying roller 16. The charging roller 11 rotates in pressure contact with the photoconductive drum 10. A developing blade 17 is in pressure contact with the developing roller 15, and forms a thin layer of toner on the developing roller 15. The supplying roller 16 rotates in pressure contact with the developing roller 15, and supplies the toner in the toner reservoir 18 above the supplying roller 16 to the developing roller 15.

A cartridge receiving portion 19 is formed on top of the developing unit 13, and receives the toner cartridge 20 attached thereto. The cartridge receiving portion 19 includes a toner receiving opening 21 and a toner reservoir 18 into which the toner is discharged from the toner cartridge 20.

Figure 5:
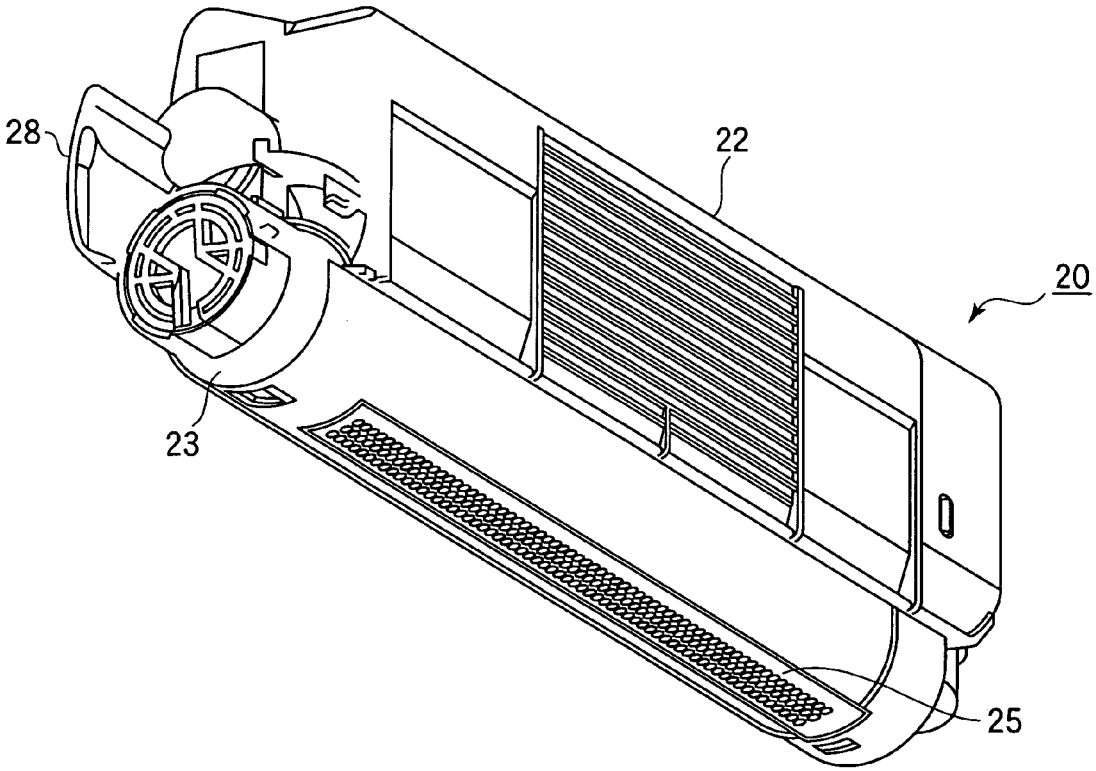
FIG. 5 illustrates the toner cartridge when a shutter has been attached to a casing.
Figure 6:
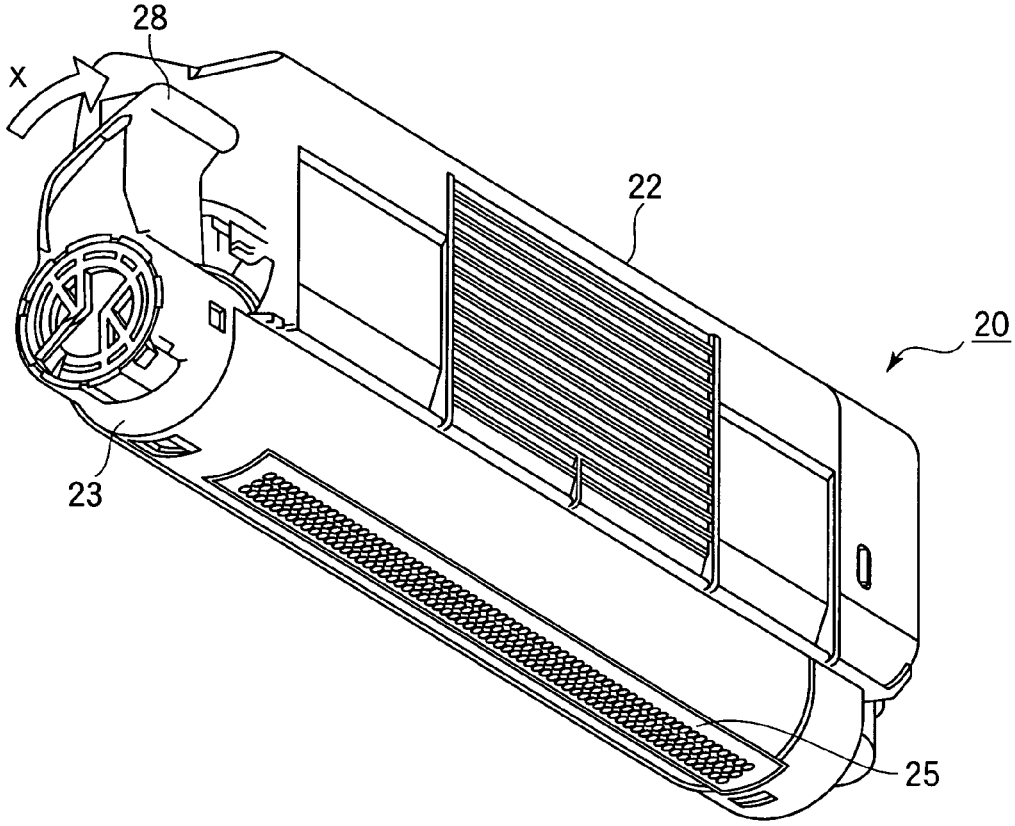
FIG. 6 illustrates the toner cartridge when the shutter is at an opening position.

Referring to FIGS. 1 and 3, the toner cartridge 20 includes a body or a casing 22 and a shutter 23. The shutter 23 is assembled through a mounting portion 24 into the casing 22. The casing 22 includes a toner discharging opening (first opening) or a mesh 25 of a plurality of mesh openings 26 formed in its bottom. When the toner cartridge 20 has been attached to the cartridge receiving portion 19, the mesh 25 faces the toner receiving opening 21. As shown in FIG. 3, the shutter 23 is then rotated to an opening position, moving from its closing position (FIG. 5) to its opening position (FIG. 6).

Figure 4:
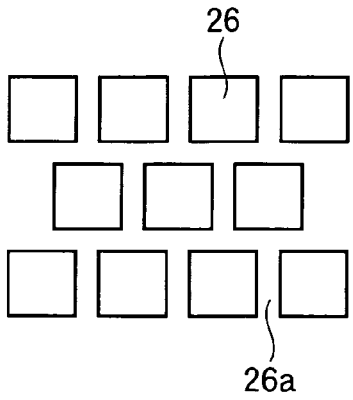
FIG. 4 illustrates square-shaped openings.

Referring to FIG. 1, the mesh 25 includes a plurality of mesh openings 26 of equal size formed therein. The toner particles are discharged from the toner cartridge 20 through the mesh openings 26. FIG. 4 illustrates the mesh openings 26 which are-square holes and are arranged in a staggered fashion. In other words, the mesh openings 26 are arranged in a plurality of rows extending in a longitudinal direction of the toner cartridge 20 such that the mesh openings 26 in one of adjacent rows are staggered with respect to the openings in the other of the adjacent rows.

The shutter 23 is generally in the shape of a hollow cylinder, and includes second openings or openings 27*a*-27*c* arranged one behind the other in a longitudinal direction of the shutter 23. The openings 27*a*-27*c* a repartitioned by reinforcements 27*d*. Each opening 27*a*-27*c* is much larger than each mesh opening 26. An operation lever 28 is formed a tone longitudinal end of the shutter 23 as shown in FIG. 1. Once the toner cartridge 20 has been attached to the developing unit 13, a user may operate the operation lever 28 to rotate the shutter 23 relative to the mounting portion 24, causing the openings 27*a*-27*c* to face the mesh 25.

A sealing sponge 23*a* is bonded to an outer cylindrical surface of the shutter 23 by means of a double side adhesive tape. When the shutter 23 is at the closing position, the sealing sponge 23*a* surrounds the mesh 25. The sealing sponge 23*a* seals the gap between the shutter 23 and the inner surface of the casing 22, preventing the toner from leaking from the toner cartridge 20 through the gap.

{Operation}

The operation of the toner cartridge 20 of the first embodiment will be described. FIG. 5 illustrates the toner cartridge 20 when the shutter 23 has been attached to the casing 22 and is at the closing position. With the shutter 23 positioned at the closing position, the toner cartridge 20 is attached to the cartridge receiving portion 19 of the developing unit 13. FIG. 6 illustrates the toner cartridge 20 when the shutter 23 is at the opening position. When the user rotates the operation lever 28 in a direction shown by arrow X (FIG. 6) after the toner cartridge 20 has been received by the cartridge receiving portion 19, the shutter 23 moves to the opening position, where the openings 27*a*-27*c* directly face the mesh 25 as shown in FIG. 3. This allows the toner to be discharged from the toner cartridge 20 into the developing unit 13.

Because the openings 27*a*-27*c* of the shutter 23 directly face the mesh 25 of the toner cartridge 20, the toner flows out of the toner cartridge 20 through the openings 27*a*-27*c* and toner discharge opening 25 into the toner receiving opening 21 of the developing unit 13. Thus, the toner is directed into the toner reservoir 18.

Figure 7:
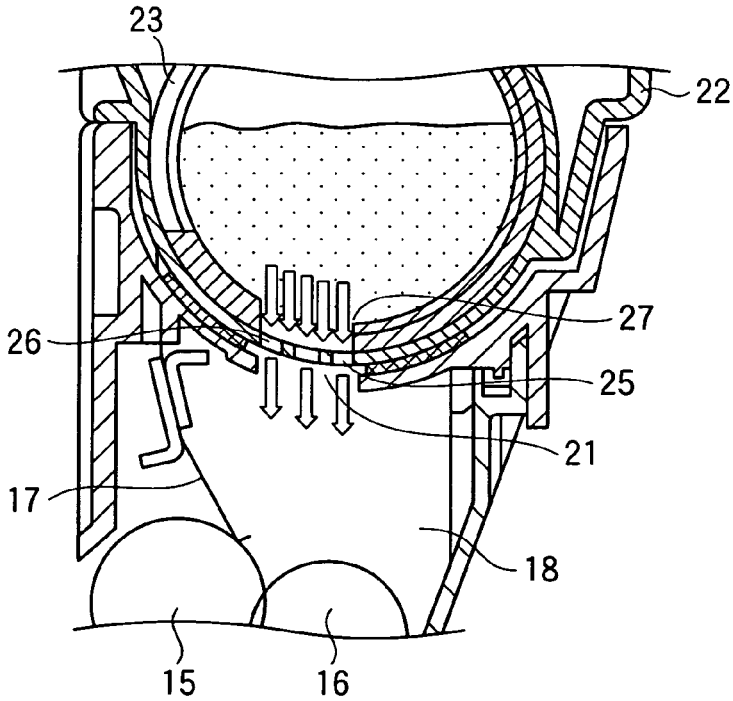
FIG. 7 illustrates when toner is being supplied into a toner reservoir of a developing unit.

FIG. 7 illustrates when the toner is being supplied into the toner reservoir 18.

Figure 8:
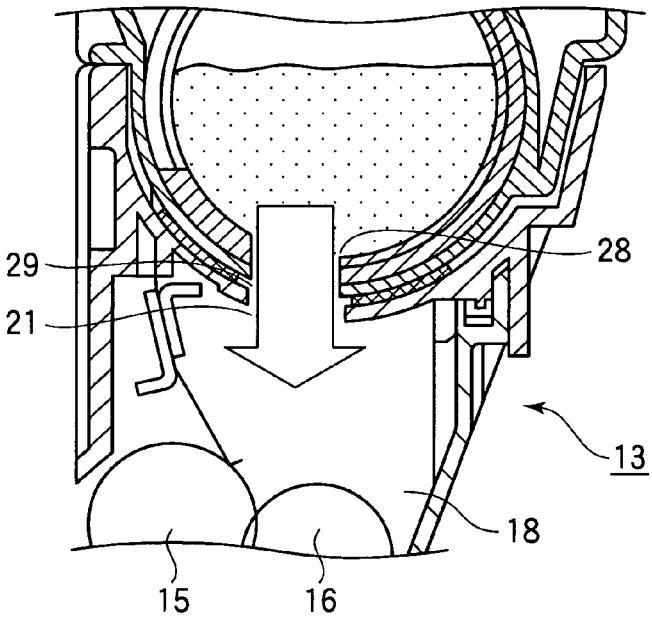
FIG. 8 illustrates a conventional toner cartridge when the toner is being supplied into the toner reservoir.

FIG. 8 illustrates a conventional toner cartridge when the toner is being supplied into the toner reservoir 18.

Referring to FIG. 8, the opening 28 of the shutter, toner discharging opening 29, and toner receiving opening 21 are wide open. Thus, the whole toner in the toner cartridge directly exerts pressure on the toner held in the toner reservoir 18.

Referring to FIG. 7, the mesh 25 of the casing 22 of the first embodiment includes a plurality of mesh openings 26. Therefore, a part of the pressure of the whole toner in the toner cartridge 20 is received by the portions of the casing 22 that define the mesh openings 26, preventing the pressure of the whole toner in the toner cartridge 20 from being directly exerted on the toner in the toner reservoir 18. This minimizes the decrease in the flowability of the toner in the toner reservoir 18, being advantageous to maintain good print quality.

The mesh openings 26 forming a mesh as a whole is advantageous in that the mechanical strength or rigidity of the casing 22 in the vicinity of the openings 27*a*-27*c* is improved, preventing the casing 22 from being deformed by external forces as well as preventing the toner from leaking through the gap between the mesh 25 and the shutter 23.

Figure 9:
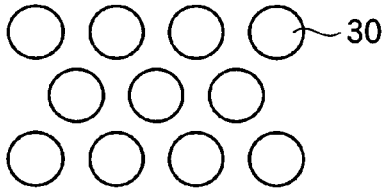
FIGS. 9-10 illustrate modifications to the openings formed in a mesh.
Figure 10:
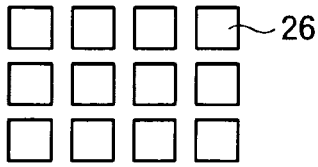

FIGS. 9-10 illustrate modifications to the mesh openings 26.

Figure 11:
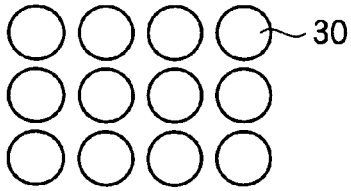
FIGS. 11 and 12 illustrate modifications to the openings.
Figure 12:
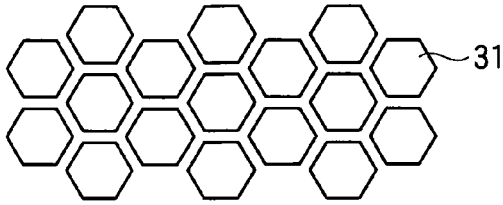

FIGS. 11 and 12 illustrate additional modifications to the mesh openings 26.

The mesh openings 26 have been described as having a size of 4 mm×4 mm. However, the mesh openings 26 having a size in the range of 1 mm×1 mm to 6 mm×6 mm also provide substantially the same advantages as the openings having a size of 4 mm×4 mm. In addition, the mesh openings 26 are arranged in a staggered configuration. Instead, round or circular openings 30 (FIG. 9) may be used in place of the square mesh openings 26. Still alternatively, square mesh openings 26 may be arranged on grids as shown in FIG. 10 or the round openings 30 may be arranged on grids as shown in FIG. 11. Yet alternatively, polygonal openings or hexagonal openings 31 may be arranged in a honeycomb pattern as shown in FIG. 12.

Figure 13A:
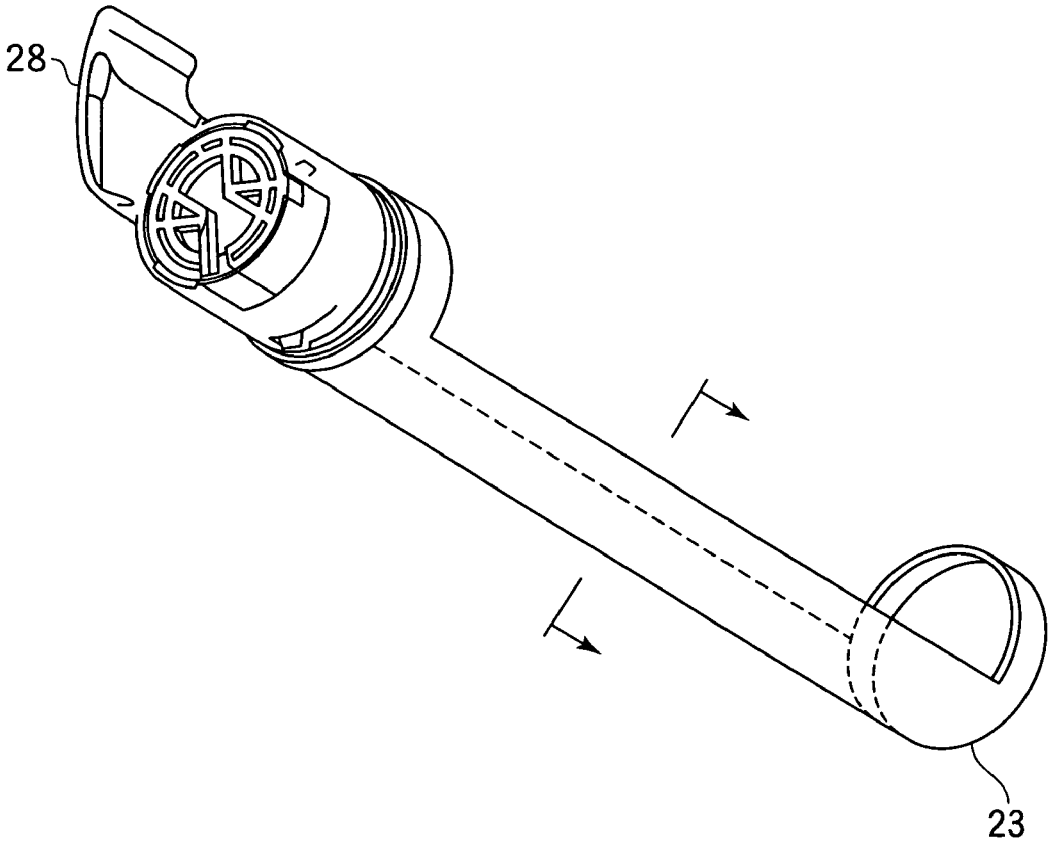
FIGS. 13A and 13B illustrate a modification to the shutter.
Figure 13B:
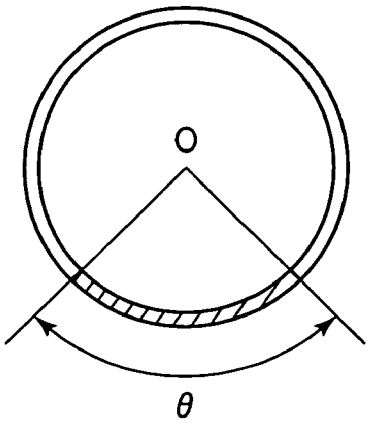

FIGS. 13A and 13B illustrate a modification to the shutter 23. While the first embodiment has been described with respect to the shutter 23 having the opening 27*a*-27*c*, the shutter may not be a substantially hollow cylinder but may be a merely arcuate wall or a partially cylindrical wall encompassing a predetermined angle θ of circumference without any opening formed in the wall as shown in FIGS. 13A and 13B.

Second Embodiment

{Construction}

Figure 14:
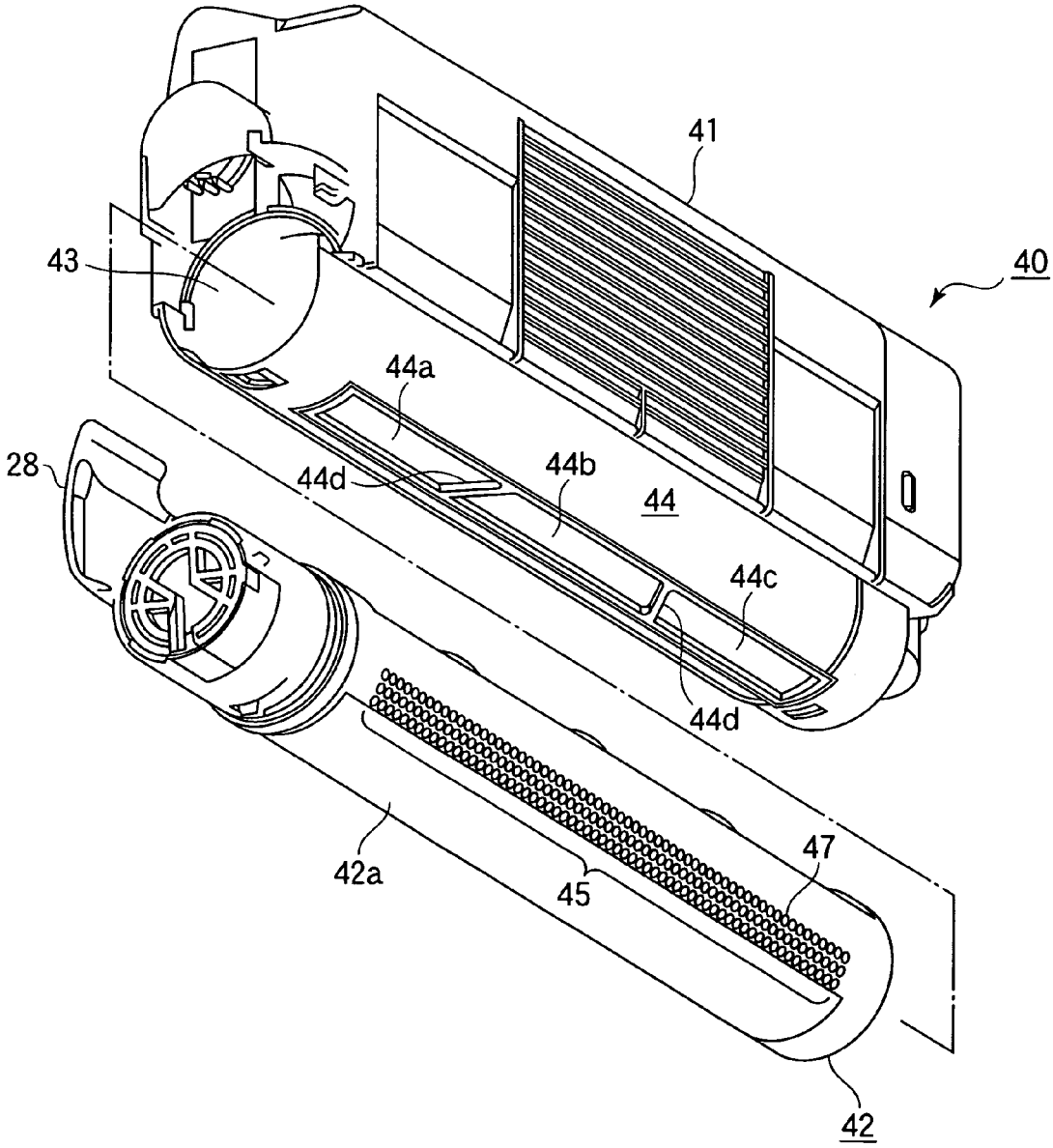
FIG. 14 is an exploded perspective view of a toner cartridge of a second embodiment.

FIG. 14 is an exploded perspective view of a toner cartridge 40 of a second embodiment.

Referring to FIG. 14, the toner cartridge 40 includes a body or a casing 41 and a shutter 42. The shutter 42 is rotatably attached into the casing 41 through a shutter receiving opening 43. The casing 41 includes first openings or toner discharging openings 44*a*-44*c* formed in its bottom wall of the shutter receiving opening 43. The toner discharging openings 44*a*-44*c* differ from the toner discharging opening or the mesh 25 of the first embodiment, but are much larger openings partitioned by a plurality of reinforcements 44*d*.

The shutter 42 is generally in the shape of a hollow cylinder having second opening or a mesh 45 in which a plurality of mesh openings 47 are formed, the holes extending as a whole in a longitudinal direction of the shutter 42. The shutter 42 includes an operation lever 28 formed at one longitudinal end of the shutter 42. When a user operates the operation lever 28 to an opening position after the shutter 28 has been attached to a developing unit 13, the shutter 42 rotates to the opening position where the mesh 45 directly face the toner discharging openings 44*a*-44*c*. A sealing sponge 42*a* is bonded to an outer cylindrical surface of the shutter 42 by means of a double side adhesive tape. When the shutter 42 is at a closing position, the sealing sponge surrounds the toner discharging opening 44*a*-44*c*. The sealing sponge 42*a* seals the gap between the shutter 42 and the inner surface of the casing 22, preventing the toner from leaking from the toner cartridge 40 through the gap.

The mesh 45 formed in the shutter 42 are in the shape of a mesh having small mesh openings 47 such that the toner is discharged from the toner cartridge 40 through the small mesh openings 47. The small mesh openings 47 are arranged in a plurality of rows such that the mesh openings 47 in one of adjacent rows are staggered with respect to the mesh openings 47 in the other of the adjacent rows.

Figure 17:
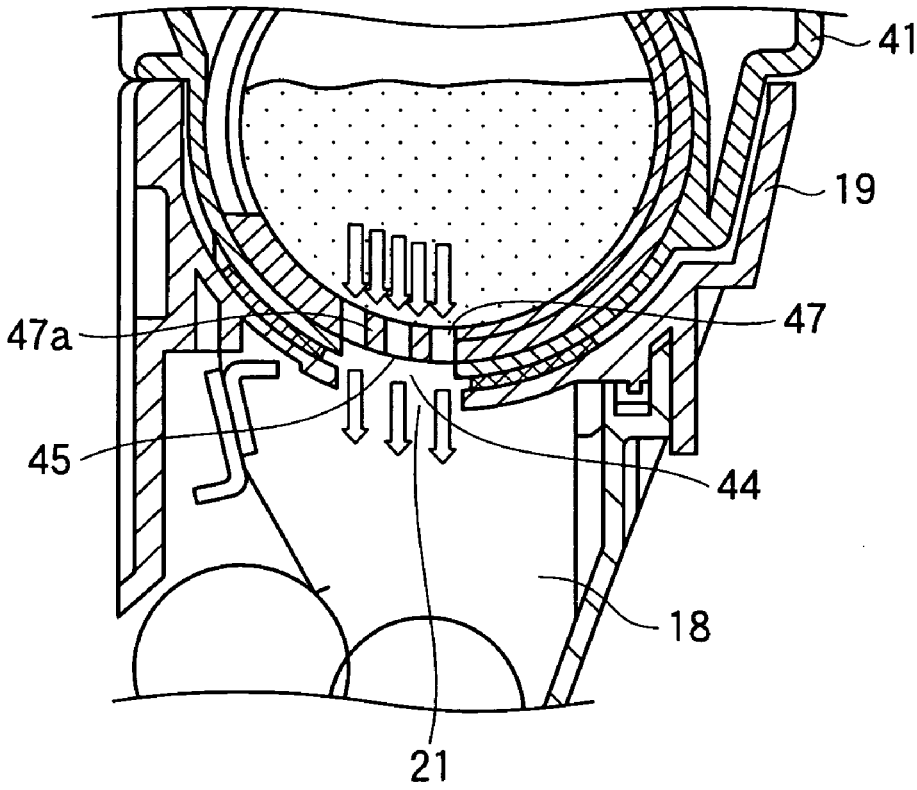
FIG. 17 illustrates when the toner is being supplied from the toner cartridge into the developing unit.

When the toner cartridge 20 is attached to the cartridge receiving portion 19 (FIG. 3), the toner discharge openings 44*a*-44*c* directly face a toner receiving openings 21 (FIG. 17).

{Operation}

The operation of the toner cartridge 40 of the second embodiment will be described.

Figure 15:
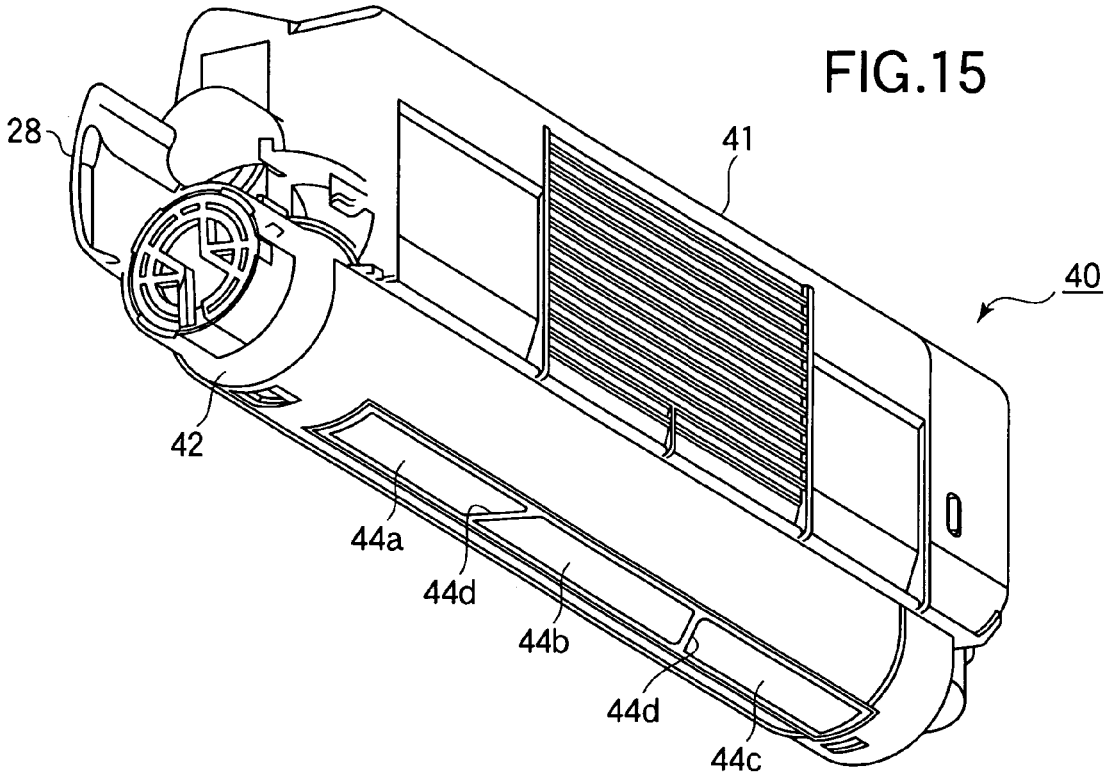
FIG. 15 illustrates the toner cartridge when the shutter has been assembled to the casing and is at its closing position.

FIG. 15 illustrates the toner cartridge 40 when the shutter 42 has been assembled to the casing 41 and is at the closing position.

Figure 16:
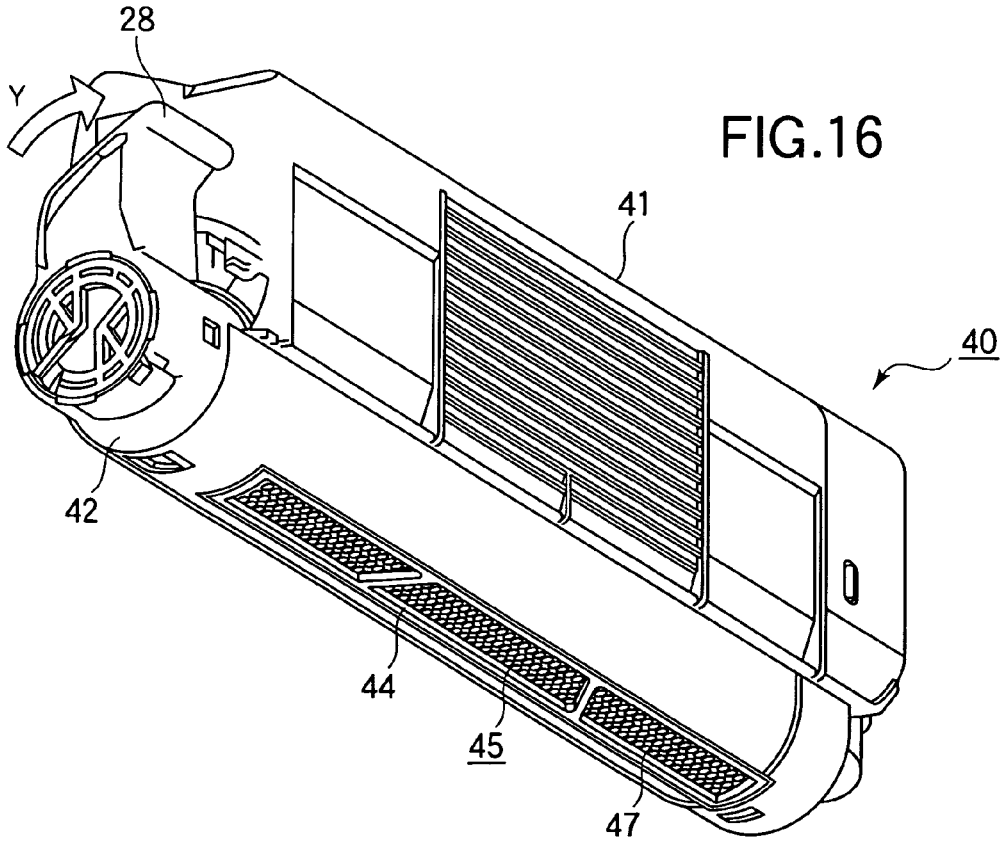
FIG. 16 illustrates the toner cartridge when an operation lever has been rotated to the opening position.

FIG. 16 illustrates the toner cartridge 40 when the operation lever 28 has been rotated to the opening position.

FIG. 17 illustrates when the toner is being supplied from the toner cartridge 40 into the developing unit 13.

With the shutter 42 at the closing position, the toner cartridge 40 is mounted to the cartridge receiving portion 19 of the developing unit 13 (FIG. 3). After the toner cartridge 40 has been attached to the developing unit 13, if the user operates the operation lever 28 to rotate in a direction shown by arrow Y (FIG. 16), the shutter 42 is opened, so that the mesh 45 directly faces the toner discharging opening 44*a*-44*c* of the casing 41 (FIG. 17). Thus, the toner may be supplied from the toner cartridge 40 into a toner reservoir 18 of the developing unit 13.

Once the mesh 45 of the shutter 42 directly faces the toner discharging openings 44*a*-44*c*, the toner in the toner cartridge 40 is discharged through the mesh 45, toner discharging opening 44*a*-44*c* and toner receiving openings 21 into the toner reservoir 18 of the developing unit 13.

Because the mesh 45 of the shutter 42 is in the form of a mesh having a plurality of small holes, the pressure of the toner in the toner cartridge 40 is reduced by the mesh, thereby reducing the total pressure exerted on the toner in the toner reservoir 18.

Boundaries 47*a* (FIG. 17) that define the mesh openings 47 receive a fraction of the pressure of the toner when the toner is discharged into the toner reservoir 18, so that the toner in the toner reservoir 18 receives less pressure and does not loose its flowability significantly.

The use of a mesh improves the mechanical strength or rigidity of the shutter 42, preventing the shutter 42 from being twisted due to the opening and closing operation of the shutter 42, and from deforming due to external forces applied to the shutter 42. Improving rigidity is effective in maintaining a constant pressure between the shutter and the casing, which would otherwise be impaired due to the deformation of the shutter. Thus, the sealing between the shutter 42 and the casing 22 may be ensured at all times.

The mesh 45 are advantageous in that a part of the pressure of the whole toner in the toner cartridge 40 is exerted on the portions of the casing 41 that define the mesh openings 47, preventing the pressure of the whole toner in the toner cartridge 40 from being directly exerted on the toner in the toner reservoir 18. This minimizes the decrease in the flowability of the toner in the toner reservoir 18, being advantageous to maintain good print quality.

The mesh 25 of the first embodiment formed in the casing 22 include a plurality of mesh openings 26, 30, or 31 of equal size across the length of the toner cartridge. The mesh 45 of the second embodiment formed in the shutter 42 includes a plurality of mesh openings 47 of equal size across the length of the toner cartridge. The size of the mesh openings 26, 30, 31, and 47 may be different depending on the locations of the openings on the toner cartridge. If more toner should be supplied into the developing unit at a particular area in the toner reservoir 18 than at the other areas, the openings corresponding to the particular area may be larger than the other areas.

Figure 18:
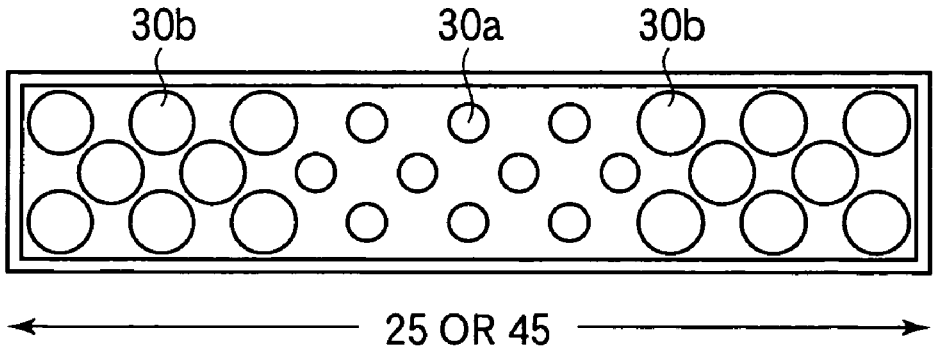
FIG. 18 illustrates the small openings formed in the mesh, the openings varying in size along the longitudinal direction of the toner discharging opening.

FIG. 18 illustrates the mesh openings that vary in size along the longitudinal direction of the mesh 25 or mesh opening) 45. For example, if less toner should be supplied into the toner reservoir 18 at the longitudinally middle portion of the toner reservoir 18 and more toner should be supplied at the longitudinal end portions, the openings 30*a* at the longitudinally middle portion should be smaller than the standard openings 30 and the openings 30*b* at the longitudinally middle portion should be larger than the standard openings 30. In this manner, a desired distribution of toner supply across the length of the toner cartridge may be achieved. The standard openings 30 have a radius of about 2.25 mm which ensures the reasonable flow rate of the toner and the mechanical strength of the casing 41. The size of the standard openings may vary depending on the ambient conditions and operating conditions of the apparatus and the conditions of the toner. For this reason, the size of the standard openings may be determined by experiment and/or theoretical calculation.

In the first and second embodiments, a plurality of openings are provided either in the mesh 25 or in the mesh 45 of the shutter. However, the plurality of openings may be formed in both the mesh 25 and the mesh 45 of the shutter such that when the shutter is at the opening position, the small holes of a mesh of the shutter are in alignment with the small holes of a mesh of the casing, in which case, the mechanical strength or rigidity of both the casing and shutter is improved and resists the deformation of the casing and shutter.

While the toner cartridges 20 and 40 have been described as being attached to an image forming apparatus, the toner cartridges of the invention may also be applied to copying machines, facsimile machines, and multi function printers (MFPs).

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A developer material holding apparatus configured to be detachably attached to a process cartridge of an image forming apparatus that forms a developer image, comprising:

a body that holds a developer material therein and includes a first opening in the form of mesh openings through which the developer material is discharged; and a shutter assembled inside said body, and being movable between an opening position where the developer material is discharged from said body and a closing position where the developer material is not discharged from said body, the shutter having a second opening formed therein and a sealing member attached to an outer surface thereof;

wherein the mesh openings in the first opening are in alignment with the second opening when said shutter is at the opening position; and the sealing member is in alignment with the first opening and is configured to close the first opening from inside when said shutter is at the closing position, the sealing member being sandwiched between the shutter and an inner surface of the body and configured to seal gaps between the shutter and close the mesh openings.

2. The developer material holding apparatus according to claim 1, wherein said shutter is slidable relative to said body.

3. The developer material holding apparatus according to claim 1, wherein the mesh openings are aligned in a plurality of rows such that openings in one of adjacent rows of the plurality of rows are staggered with respect to openings in another of adjacent rows of the plurality of rows.

4. The developer material holding apparatus according to claim 1, wherein the mesh openings are aligned on a grid system.

5. The developer material holding apparatus according to claim 1, wherein the mesh openings are polygons.

6. The developer material holding apparatus according to claim 1, wherein the mesh openings are round openings.

7. The developer material holding apparatus according to claim 1, wherein the developer material is toner.

8. The developer material holding apparatus according to claim 1, wherein the mesh openings are squares having a size in the range of 1 mm ×1mm to 6 mm ×6 mm.

9. The developer material holding apparatus according to claim 1, wherein the mesh openings are squares having a size in the range of 4 mm ×4 mm.

10. The developer material holding apparatus according to claim 1, wherein the mesh openings include different sizes depending on their locations in said body so that a rate of the developer discharged from said body is selected.

11. The developer material holding apparatus according to claim 1, wherein said body extends in a longitudinal direction, and the mesh openings are aligned in the longitudinal direction, the mesh openings including different sizes that vary in the longitudinal direction.

12. The developer material holding apparatus according to claim 1, wherein the mesh openings are larger at a longitudinal end portion than at a longitudinally middle portion.

13. The developer material holding apparatus according to claim 1, wherein said shutter is generally in the shape of a hollow cylinder.

14. The developer material holding apparatus according to claim 1, wherein said shutter is generally in the shape of a partially cylindrical wall encompassing a predetermined angle of circumference.

15. The developer material holding apparatus according to claim 1, wherein said shutter includes an operation lever.

16. An image forming apparatus incorporating the developer material holding apparatus according to claim 1.

* * * * *